US011060219B2

(12) United States Patent
Niklaus

(10) Patent No.: US 11,060,219 B2
(45) Date of Patent: Jul. 13, 2021

(54) AERODYNAMIC NONWOVEN-FORMING DEVICE AND PROCESS

(71) Applicant: AUTEFA SOLUTIONS GERMANY GMBH, Friedberg (DE)

(72) Inventor: Michael Niklaus, Seuzach (CH)

(73) Assignee: AUTEFA SOLUTIONS GERMANY GMBH, Friedberg (DE)

( * ) Notice: Subject to any disclaimer, the term of this patent is extended or adjusted under 35 U.S.C. 154(b) by 198 days.

(21) Appl. No.: 16/336,320

(22) PCT Filed: Sep. 26, 2017

(86) PCT No.: PCT/EP2017/074294

§ 371 (c)(1),
(2) Date: Mar. 25, 2019

(87) PCT Pub. No.: WO2018/055181

PCT Pub. Date: Mar. 29, 2018

(65) Prior Publication Data

US 2020/0149199 A1 May 14, 2020

(30) Foreign Application Priority Data

Sep. 26, 2016 (DE) ..... 20 2016 105 337.4

(51) Int. Cl.
*D04H 1/732* (2012.01)
*D04H 1/56* (2006.01)

(52) U.S. Cl.
CPC ..... *D04H 1/732* (2013.01); *D04H 1/56* (2013.01)

(58) Field of Classification Search
None
See application file for complete search history.

(56) References Cited

U.S. PATENT DOCUMENTS 3,481,005 A * 12/1969 Zafiroglu ..... D04H 1/72 19/306
4,869,855 A * 9/1989 Twilley ..... B01D 39/1623 264/462
5,974,631 A * 11/1999 Leifeld ..... D04H 1/12 156/322

(Continued)

FOREIGN PATENT DOCUMENTS

CN 105 624 923 A 6/2016
DE 44 30 500 A1 2/1996
DE 197 40 338 A1 3/1999

(Continued)

OTHER PUBLICATIONS

Translation of WO 01/14623.*

*Primary Examiner* — Mary Lynn F Theisen
(74) *Attorney, Agent, or Firm* — McGlew and Tuttle, P.C.

(57) ABSTRACT

An aerodynamic nonwoven forming device (2) for a fibrous nonwoven (10), the nonwoven forming device (2) having a discharge region (6) for fibers, in which the fibrous nonwoven (10) is aerodynamically formed. The nonwoven forming device (2) is incorporated in the discharge region (6) in a furnace (4). The nonwoven forming device (2) has a fiber support (5) which emits a fiber stream (12) in the discharge region (6) into a free area (31) within the furnace (4). The fiber support (5) spins off the fiber stream (12) on a detachment area (22) into the free area (31) in free flight.

20 Claims, 4 Drawing Sheets

(56) References Cited

U.S. PATENT DOCUMENTS

| | | | | |
|---|---|---|---|---|
| 2010/0252047 | A1* | 10/2010 | Kirk | B03C 7/006<br>128/206.19 |
| 2016/0215422 | A1 | 7/2016 | Rademacker et al. | |

FOREIGN PATENT DOCUMENTS

| | | | |
|---|---|---|---|
| DE | 10 2013 106 457 | B3 | 9/2014 |
| DE | 20 2014 102 656 | U1 | 9/2015 |
| WO | 01/14623 | A2 | 3/2001 |
| WO | 02/088441 | A1 | 11/2002 |

* cited by examiner

COLD
HOT
1
2
3
4
5
6
7
8
9
10
11
12
13
14
15
16
17
18
19
20
21
22
23
24
25
26
31

COLD
HOT
1
2
3
4
5
6
7
8
9
9'
10
11
11
12
13
14
15
16
17
17
18
19
20
21
22
23
24
25
25
26
31
36

AERODYNAMIC NONWOVEN-FORMING DEVICE AND PROCESS

CROSS REFERENCE TO RELATED APPLICATIONS

This application is a United States National Phase Application of International Application PCT/EP2017/074294 filed Sep. 26, 2017 and claims the benefit of priority under 35 U.S.C. § 119 of German patent application DE 20 2016 105 337.4 filed Sep. 26, 2016, the entire contents of which are incorporated herein by reference.

FIELD OF THE INVENTION

The present invention pertains to an aerodynamic nonwoven-forming device and to a nonwoven-forming process.

BACKGROUND OF THE INVENTION

Aerodynamic nonwoven-forming devices are known from practice. DE 44 30 500 A1 shows an aerodynamic nonwoven-forming device, in which a main cylinder rotating at high speed throws fibers from its jacket at ambient temperature into a connected shaft, which forms a throwing-off area. An additional air stream supports the throwing off of fibers and the fiber stream formed in the process. They are then separated from the air stream on an air-permeable conveyor belt while a fibrous nonwoven is formed. The fibrous nonwoven is sent, in practice, after it leaves the nonwoven-forming device, for further processing, e.g., for strengthening by needling, thermobonding or the like.

SUMMARY OF THE INVENTION

The object of the present invention is to show an improved aerodynamic nonwoven-forming technology.

This object is accomplished by the process and the device of the present invention. The aerodynamic nonwoven-forming technology, i.e., the nonwoven-forming device in question and the nonwoven-forming process, have various advantages.

The combination of the nonwoven-forming device with an oven makes possible a heat treatment of the fibers during an aerodynamic nonwoven-laying process. The fibers can be introduced into the oven in a cold and unbonded state and are only heated in the interior of the oven.

The fibers, preferably synthetic fibers, can be deformed thermoplastically and partially melted in the emitted fiber stream, especially airborne fibers, and also in the fibrous nonwoven formed, and their intrinsic consistency as well as their ratio to adjacent fibers can be favorably influenced by the heat introduced. A great advantage lies in the especially good accessibility of the individual fibers for the heat transfer and the specific thermal effect.

The fibers per se and/or the fiber composite formed during the nonwoven formation can be stabilized. This is also advantageous for the homogenization of the fibrous nonwoven.

The hot fibrous nonwoven may subsequently be cooled again, e.g., in a downstream cooling zone. In addition, it may be plastically deformed, e.g., embossed and possibly perforated, utilizing the thermal energy contained and the temperature. This may be carried out by means of a cold or actively cooled device, e.g., according to DE 20 2014 102 656 U1.

Further, the fibrous nonwoven already strengthened thermally at least partially can be handled more easily and more reliably during the subsequent treatment and during the conveying. The heat-treated fibrous nonwoven is, in addition, less sensitive to interfering effects during conveying and in a subsequent further treatment process. This reduces the susceptibility to error in the subsequent process or processes and ensures the quality of the end product.

Another advantage is the compact mode of construction and the reduced effort needed for construction and the reduced cost. On the other hand, the good accessibility of the fibers in free flight makes it possible to reduce the length of the thermal effect section and of the oven at the nonwoven-forming device. A thermobonding oven arranged downstream in conventional fiber plants can be eliminated or its size can be reduced owing to the aerodynamic nonwoven-forming technology according to the present invention.

A nonwoven pick-up unit is located in the throwing-off area in a preferred embodiment. This may be, e.g., a nonwoven conveyor, which may be present as a single conveyor or as a plurality of conveyors.

The nonwoven-forming device further has a fiber carrier, which emits, preferably throws off, a fiber stream into the throwing-off area. This may be effected by a rotary motion and with centrifugal effect on the fibers. The fiber emission may additionally be supported by a gas stream, especially a cold air stream.

The throwing-off area, the nonwoven pick-up unit and a part of the fiber carrier may be enclosed by an oven. They may be located especially in an inner heating atmosphere of an enclosing oven housing and a heated oven air can be admitted to them. This heating from the oven atmosphere is advantageous for a uniform and possibly all-around admission of heat to the fibers in the emitted fiber stream and in the nonwoven.

The fiber carrier may have any desired and suitable configuration and may emit the fiber stream in the throwing-off area in any desired manner. This may be carried out, e.g., by a laying belt and/or a nonwoven-forming cylinder, each arranged as a single belt or cylinder or as a plurality of belts or cylinders.

In the shown and preferred embodiments, the fiber carrier emits the fiber stream into a free space within the oven. The fibers or the fiber stream are preferably thrown off in the process, especially by centrifugal force, from a fiber carrier configured as a tambour rotating at a high speed.

During its flow in the free space, the emitted fiber stream is spaced apart from the walls of the oven housing and is also not passed through solid walls of a flow duct. The fibers are prevented hereby from caking on such hot walls. As a consequence, contamination of the interior of the oven and of the laid nonwoven with such possibly burnt or detached fiber residues is avoided as well.

The emitted fiber stream may move in the throwing-off area by free flight and along a downwardly directed ballistic curve. This flight curve may be affected by an air stream, especially a hot air stream, in the oven. The air stream, especially hot air stream, acts on the already emitted fiber stream at a spaced location from the separation area at the fiber carrier.

The hot air stream may be generated by a circulating device for the oven air. The hot air stream ensures an especially favorable thermal effect on the fibers. It may also affect, especially guide, the flight curve of the emitted fiber stream. This is advantageous for a homogenization of the fiber laying and the nonwoven formation. The nonwoven pick-up unit may additionally be heated.

The aforementioned risk of caking is not present in case of a hot air stream. The air stream, especially hot air stream, can spread out or fan out the fiber stream in the conveying direction of the laid fibrous nonwoven. As a result, more fibers can be picked up on the nonwoven pick-up unit. The fiber orientation may be, in particular, irregular. This spreading out increases the performance capacity and improves the quality of the aerodynamic nonwoven-forming technology.

In addition, the possibility of forming a nonwoven with greater thickness and lower density (so-called loft) is favorable. Such a nonwoven can be stabilized on the nonwoven pick-up unit by thermal fiber bonding. A nonwoven with higher loft is advantageous, for example, for manufacturing fluffy and yet stable pillows or the like.

A guiding device for the air stream, especially hot air stream, is advantageous for spreading out. The optionally adjustable guiding device may be configured, e.g., as an air guide blade or as a belt of a calibrating or guiding device or in another manner. Due to the guiding of the air stream, the guiding function of the air stream for the fiber stream can be influenced favorably. The air stream prevents, on the other hand, the fibers from coming into contact with and caking on the guiding device.

In another embodiment, the emitted fibers may be decelerated in the free space of the oven and form a floating fiber cloud, from which the fibers are then moved to the nonwoven pick-up unit by the force of gravity and/or suction or in another manner. The fiber cloud may be formed at a spaced location from the nonwoven pick-up unit. The aforementioned air stream, especially hot air stream, may be omitted.

The fiber carrier, especially a rotating tambour, may protrude in some areas, preferably over about half, into the oven housing. The other part of the fiber carrier may be located outside the oven housing in a cooler ambient atmosphere. The fiber carrier may have a cooling device, with which it can be cooled as a whole or possibly primarily on its jacket area. This is favorable for achieving homogenization of the fiber pick-up at the feed area and in a possibly existing, downstream treatment area with carding cylinders or the like. In addition, partial melting and adhesion of the fibers are avoided in this area. The throwing off of the fibers from a rotating fiber carrier, especially from a tambour, at the separation point is facilitated and stabilized. Interferences due to premature thermal effect can be avoided or at least reduced.

The fibrous nonwoven at the nonwoven pick-up unit, especially at a nonwoven conveyor, can be stabilized and held by means of a holding device, especially a suction device. The preferably air-permeable nonwoven pick-up unit possibly also facilitates the separation of the fibers from an accompanying hot air stream.

The calibrating and guiding unit can ensure a thickness calibration and/or compaction of the fibrous nonwoven on the nonwoven pick-up unit. The circulating belt of the calibrating and guiding unit may be permeable to air. It may have a dual function for guiding an air stream, especially hot air stream, for guiding the fiber stream, on the one hand, and for setting the thickness of and/or compacting the nonwoven at the nonwoven pick-up unit, on the other hand. The circulating belt may extend within and outside the oven. It may be led out of the oven and to an external treatment device for cleaning and possibly cooling, etc.

The air-permeable belt may also interact with a ventilating device in the oven. Blowing and suction streams may be directed through the belt into the oven, especially into the throwing-off area located there. The ventilating device may cooperate during the guiding of the fiber stream by means of the air. In addition, it may influence and set the air balance.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

The present invention pertains to an aerodynamic nonwoven-forming device (2) and to a nonwoven-forming process. The present invention further pertains to a fiber plant (1) equipped with such an aerodynamic nonwoven-forming device (2). The aerodynamic nonwoven formation technology is also called airlay.

Figure 1:
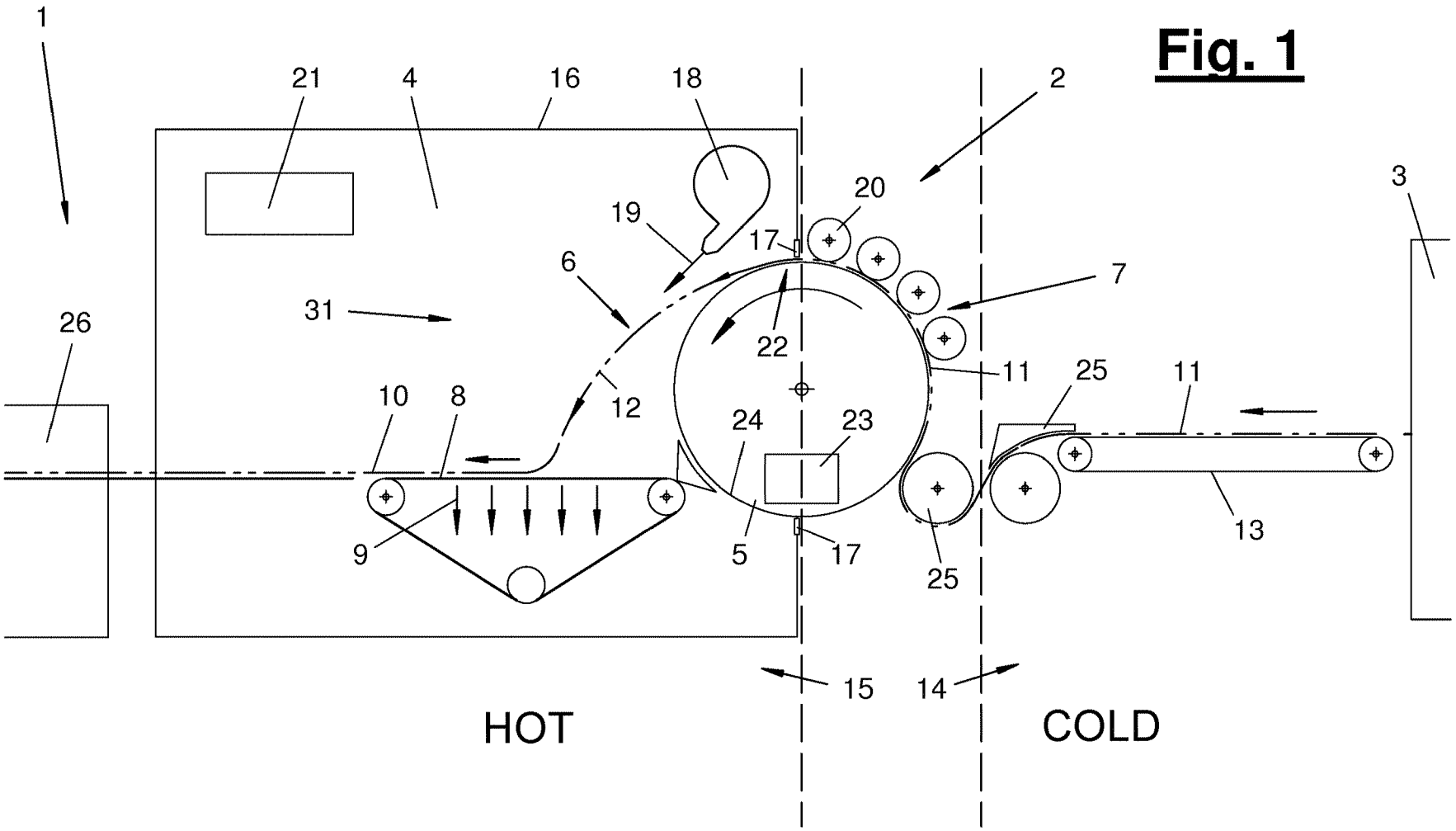
FIG. 1 is a schematic lateral view of an aerodynamic nonwoven-forming device with an oven.
Figure 2:
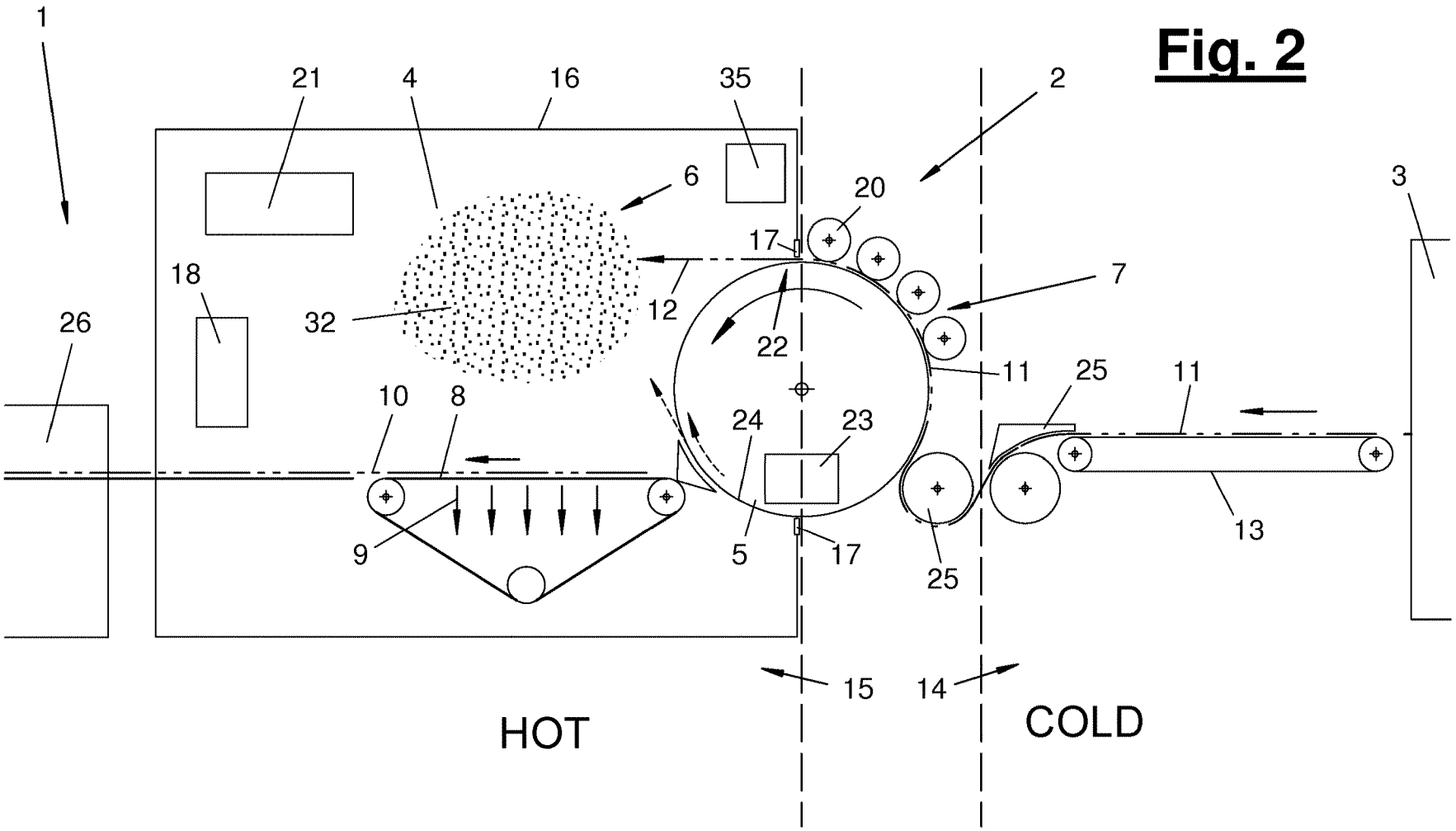
FIG. 2 is a view of a variant of the aerodynamic nonwoven-forming device with an oven from FIG. 1.

FIGS. 1 and 2 schematically show the aerodynamic nonwoven-forming device (2) and parts of the fiber plant (1). A fibrous nonwoven (10) is formed aerodynamically from the fibers fed at the inlet (7) in the nonwoven-forming device (2). The fibrous nonwoven may then be subjected to further treatment. The aerodynamic nonwoven-forming device (2) and the nonwoven-forming process will be described in more detail below.

The fiber plant (1) may have a fiber supplier (3), which is arranged upstream of the nonwoven-forming device (2) in the process direction indicated by an arrow. The fiber supplier (3) may have any desired configuration, e.g., as a fiber processing unit, as a vibrating shaft feeder, as a feeding shaft or the like. It produces a fibrous web (11), which is fed to the inlet area (7) of the nonwoven-forming device (2) by means of a fiber feed device (13). The fiber feed device (13) may be configured, e.g., as a conveyor belt, especially as an endless circulating belt conveyor. It conveys the fibrous web (11) to the inlet area (7) and guides same in the process via a plurality of guide devices (25) in a suitable manner.

The fiber plant (1) may have, as an alternative or in addition, one or more further treatment devices (26), which is/are arranged after the nonwoven-forming device (2) in the process direction. A further treatment device (26) may be, e.g., a strengthening device, a nonwoven-layering apparatus, especially a crosslayer, or the like. A strengthening device may be configured, e.g., as a needling machine, as a hydroentanglement device, as a thermobonding oven, or in another manner. The fiber supplier (3) and the further treatment device (26) are shown schematically in FIG. 1.

The fibers processed in the fiber plant (1) and in the aerodynamic nonwoven-forming device (2) may be of any desired and suitable type and configuration. They are preferably textile fibers from a synthetic material. They may be configured as so-called staple fibers or short-cut fibers. As an alternative, they may be natural fibers or a composite material.

The aerodynamic nonwoven-forming device (2) has a throwing-off area (6) for the fibers, in which the fibrous nonwoven (10) is formed aerodynamically. This aerodynamic nonwoven formation may be carried out in different manners. It is carried out by throwing off the fibers in the exemplary embodiment shown.

The nonwoven-forming device (2) has a fiber carrier (5). This picks up the fibrous web (11) fed at the inlet (7), e.g., on its outer circumference. This is effected in the exemplary embodiment shown by the aforementioned throwing off by means of centrifugal force. The fibers leave the fiber carrier (5) at a separation area (22).

Fiber processing, especially carding, may also be carried out at the fiber carrier (5). One or more treatment devices (20) may be present for this and they may be arranged, e.g., on the outer circumference of the fiber carrier (5). This device or these devices may be, e.g., rotating treatment cylinders or carding cylinders.

The fiber carrier (5) may have any desired and suitable configuration. In the exemplary embodiments shown, it is a tambour, which rotates about a central axis at a high speed. The tambour (5) has a cylindrical shape and has an outer jacket (24), at which the fibrous web (11) is picked up. A suitable coating, e.g., a scratch-resistant coating or the like, may be arranged on the jacket (24).

The features mentioned below in connection with the tambour generally apply to a fiber carrier (5) and, in a corresponding structural adaptation, also to other configurations of the fiber carrier (5), e.g., in the form of a bent conveyor belt circulating at a high speed.

FIG. 1 shows a first variant of the nonwoven-forming device (2). Said separation area (22), at which the fibers from the fibrous web (11) leave the tambour (5) and are emitted in the fiber stream (12) and are especially thrown off, is located at a suitable circumferential point, e.g., at the upper apex area, of the tambour (5). The emitted fiber stream (12) may be oriented horizontally or obliquely.

The nonwoven-forming device (2) has a nonwoven pick-up unit (8), which is located in the throwing-off area (6) and at or on which the fibrous nonwoven (10) is formed from the arriving fiber stream (12). The nonwoven pick-up unit (8) may have any suitable configuration and orientation. It preferably has a horizontal orientation. As an alternative, the orientation may be oblique or also vertical. The nonwoven pick-up unit (8) is formed in the exemplary embodiment shown by a single nonwoven conveyor or a plurality of nonwoven conveyors, e.g., an endless circulating belt type conveyor, which moves the fibrous nonwoven (10) formed in the direction of the arrow and possibly removes it from the nonwoven-forming device (2).

The nonwoven pick-up unit (8), especially the nonwoven conveyor, may have an air-permeable configuration. The conveyor belt of the nonwoven conveyor (8) is, e.g., perforated for this purpose or is configured as an air-permeable fabric or grid or in another suitable manner. The nonwoven pick-up unit (8), especially the nonwoven conveyor, may be arranged under the separation area (22) and the throwing-off area (6).

A holding device (9), which holds the fibrous nonwoven (10) on the nonwoven pick-up unit (8) and stabilizes it, may be arranged at the nonwoven pick-up unit (8). The holding device (9) may have any desired and suitable configuration, e.g., as a suction device, and act from below on the air-permeable nonwoven pick-up unit (8) and on the fibrous nonwoven (10) lying on same. As an alternative or in addition, an upper cover (9'), e.g., an additional endless circulating conveyor belt, which adjoins the entry area of the fiber stream (12) in the conveying direction, may be present. The cover (9'), shown, e.g., in FIG. 3, may move synchronously with the nonwoven pick-up unit (8) and may possibly clamp the fibrous nonwoven (10) from the top.

The fibrous nonwoven (10) is formed by the fiber stream (12) reaching the nonwoven pick-up unit (8). The fiber stream (12) thrown off into the free space (31) at the separation area (22) moves downward by free flight and along a ballistic curve indicated in FIG. 1. The fiber stream (12) may be influenced in the process by a gas stream (19), especially an air stream. It may especially be guided and accelerated.

The fiber stream (12) extends over the width of the tambour (5) and the corresponding width of the nonwoven pick-up unit (8). The impacting fibers collect on the nonwoven pick-up unit (8) being moved in the conveying direction and form, due to the aerodynamic nonwoven-layering principle, a highly uniform fiber layer, which has especially a weight per unit area that is constant over the width of the fibrous nonwoven (10) and of the fiber stream (12). The weight per unit area is preferably also constant in the conveying direction of the fibrous nonwoven (10). The layer thickness and the value of the weight per unit area depend on the speed of conveying of the nonwoven pick-up unit (8) and the quantity of fibers fed and may be set at correspondingly different values. It is possible in one variant to vary the weight per unit area over the width and/or in the longitudinal direction during the nonwoven-forming process as needed.

The nonwoven-forming device (2) is integrated into an oven (4) in the throwing-off area. This integration may also concern other areas of the nonwoven-forming device (2). In particular, the nonwoven pick-up unit (8) is also arranged at least in some areas in the oven (4). A part of the fiber carrier (5) is preferably also enclosed by the oven (4). The oven (4) has a preferably insulated housing (16) with an inner heating atmosphere and with a heated oven air. The oven air may also consist of a process gas.

The housing (16), which is, e.g., cubic, encloses with the heating atmosphere the throwing-off area (6) and at least a part of the nonwoven pick-up unit (8) as well as preferably also an area of the fiber carrier (5), especially the separation area (22). In the embodiment shown, the rotating tambour (5) protrudes in some areas into the oven housing (16). It may protrude, e.g., over half into the oven housing (16).

The housing (16) of the oven (4) may be sealed against the rotating tambour (5). A respective seal (17), which is set against the jacket (24) of the tambour (5) in a suitable manner, is located now, e.g., at the housing edges at the housing inlet point. The distance or gap is selected to be such that escape of heat from the oven (4) is prevented to the greatest extent possible, and, on the other hand, the fibrous web (11) can enter the oven housing (16) and reach the separation area (22) unhindered in the upper apex area. In addition, the air stream entrained by the rotating tambour (5) can be kept extensively away from the interior of the oven and from the separation area (22) as well as from the throwing-off area (6) by the seals (17). As an alternative, cool gas, especially air, can be fed from the outside at the separation area (22) in a defined manner.

The heating atmosphere acts on and heats the partial area of the rotating tambour (5), which protrudes into the interior of the oven, e.g., on about half of the tambour. The other partial area of the tambour is located outside the housing (16) in a cooler surrounding area. The fibers are fed on this cold outer side or inlet side (7).

The tambour (5) may have a cooling device (23). The tambour (5) can be cooled with this as a whole or at least on its jacket area (24). The heat absorbed in the oven area can now be removed, so that the jacket temperature remains low on the cold feed side (7) and an undesired adhesion of fibers as well as an interference with the carding process are prevented.

The oven (4) has a built-in or external heating device (21) and possibly a circulating device (18) for the oven air. The devices (18, 21) may be combined or arranged separately. The circulating device (18) is configured, e.g., as a blower and it circulates the oven air in the oven housing (16). It emits, e.g., according to FIG. 1, a directed hot air stream (19) and directs this along the emitted fiber stream (12). The hot air stream (19) may be directed especially tangentially to the ballistic curve of the fiber stream (12), which is emitted, especially thrown off, into the free interior (31) of the oven (4) in the exemplary embodiment shown. The circulating device (18) is arranged, e.g., above the tambour (5) and emits an oblique, hot air stream (19), which reaches the fiber stream (12) from the top and in the flight direction at a spaced location behind the separation area (22). As an alternative, the blower may be connected to a separate gas feed, from which, e.g., cool air, hot air or another, possibly temperature-controlled gas is fed.

The hot oven atmosphere and the possibly hot air stream (19) have a temperature that changes the consistency of the fibers and makes these sticky, e.g., on the outer side, or even plasticizes or partially melts same. The air temperature may be above the plasticization temperature, especially the melting point, of the fibers. The temperature may be controlled and preferably also regulated. It may also be adapted to different types of fibers.

The fibers are subjected to thermal effect and, e.g., partially melted in the emitted fiber stream (12). In addition, they are guided or routed in the flight path by the air stream (19). The air stream (19) also brings about homogenization of the fiber stream (12) and of the fibers contained therein. This leads to homogenization of the fibrous nonwoven (10). The air stream (19) can be separated from the fiber stream (12) at the preferably air-permeable nonwoven pick-up unit (8), and the holding device (9), especially a suction device, may exert a supporting effect.

The nonwoven pick-up unit (8) may, in turn, be heated in any desired and suitable manner. Its contact surface and the endless circulating conveyor belt have, in particular, an actively controllable and possibly regulatable temperature as a result. This temperature may correspond to the temperature of the oven atmosphere or be higher or lower as needed.

The laid fibers are also plasticized and connected by the thermal effect of the oven atmosphere and possibly of the heated nonwoven pick-up unit (8) on the fibrous nonwoven (10). The fiber composite in the fibrous nonwoven (10) is stabilized and can be conveyed more easily.

The nonwoven pick-up unit (8) may be located entirely within the oven housing (16). It may possibly also project from the oven housing (16) through an outlet-side opening. In another variant, it is possible to arrange additional conveyors for the fibrous nonwoven (10) within and outside the oven housing (16). The fibrous nonwoven (10) may be conveyed in the shown and essentially horizontal as well as straight position. As an alternative, it may be guided and conveyed over a curved path by means of rollers or other similar guide devices.

The blower (18) may be configured, e.g., as a circulating air blower or radial blower, which extends over the width of the tambour (5), of the fiber stream (12) and of the nonwoven pick-up unit (8). Such a radial blower may have, e.g., an axial intake and an outlet on the circumference of the blower rotor. In addition, any other configurations of the circulating device (18) are possible. Guiding devices, not shown, or other devices for generating a preferably circulating flow of the oven air, may be arranged in the interior of the oven housing (16).

As is schematically shown in FIG. 1, the nonwoven-forming device (2) may be divided into a hot, internal zone (15) in the oven area and a cold and external zone (14), which is spaced apart herefrom, possibly in the process direction or feed direction. The latter may extend in the inlet area (7) or in the area of the fiber feed device (13) and farther to the fiber supplier (3). Ambient temperature or a low temperature, generated, e.g., by a cooling device (not shown), may prevail in the cold zone (14). The zones (14, 15) may be spaced apart from one another in the process direction. An intermediate temperature or mixed temperature or possibly a separate atmosphere may be present in the intermediate area.

The nonwoven pick-up unit (8) may have a different, e.g., oblique, orientation in other embodiments.

FIG. 2 shows a variant of the nonwoven-forming device (2), which is largely identical to the first variant according to FIG. 1, identical reference numbers designating identical parts.

In the second variant, the fiber stream (12) is emitted by the fiber carrier (5) into the throwing-off area (6) and into the free interior (31) as well as into the hot oven atmosphere present there such that the velocity of flight of the fibers is decelerated and the fibers form a floating fiber cloud (32). The fiber cloud (32) and the throwing-off area (6) are arranged at spaced locations from the nonwoven pick-up unit (8), especially above the nonwoven pick-up unit (8). The decelerated fibers fall from the fiber cloud onto the nonwoven pick-up unit (8) under the force of gravity and/or under the effect of the holding device (9), especially due to suction. The nonwoven formation may likewise be controlled or regulated. The nonwoven pick-up unit (8) may be arranged, as an alternative, at another location, especially above the fiber cloud (32).

Acceleration and guiding of the emitted fiber stream (12) by an air stream (19) may be done away with in the second variant. A circulating device (18) for the oven air may be eliminated here or it may have a different, especially weaker, configuration, such that the formation of the floating fiber cloud (32) is made possible.

The separation point (22) at the fiber carrier (5) may be located, as in the first variant, at the upper circumferential area, especially at the upper apex. The fiber stream (12) may be emitted essentially horizontally. The separation point (22) may be arranged, as an alternative, according to the view indicated by broken lines in FIG. 2, at the lower circumferential area, the fiber stream (12) being emitted obliquely upwards. The fiber carrier (5) has a correspondingly modified rotation direction here, which is suggested by an arrow drawn in broken line.

Further, the nonwoven-forming device (2) may have a charging device (35), which is schematically suggested in FIG. 2 and which imparts electrical or electrostatic charge on the fibers. It may act on the fibers emitted by the fiber carrier (5), especially on the fiber cloud (32). The charging device (35) may be arranged in a suitable location of the nonwoven-forming device (2), e.g., in the oven area. As an alternative or in addition, the fibers may be charged in another location, e.g., in the inlet area (7) and/or at the fiber carrier (5). The charging device (35) may also be used in the first variant.

Figure 3:
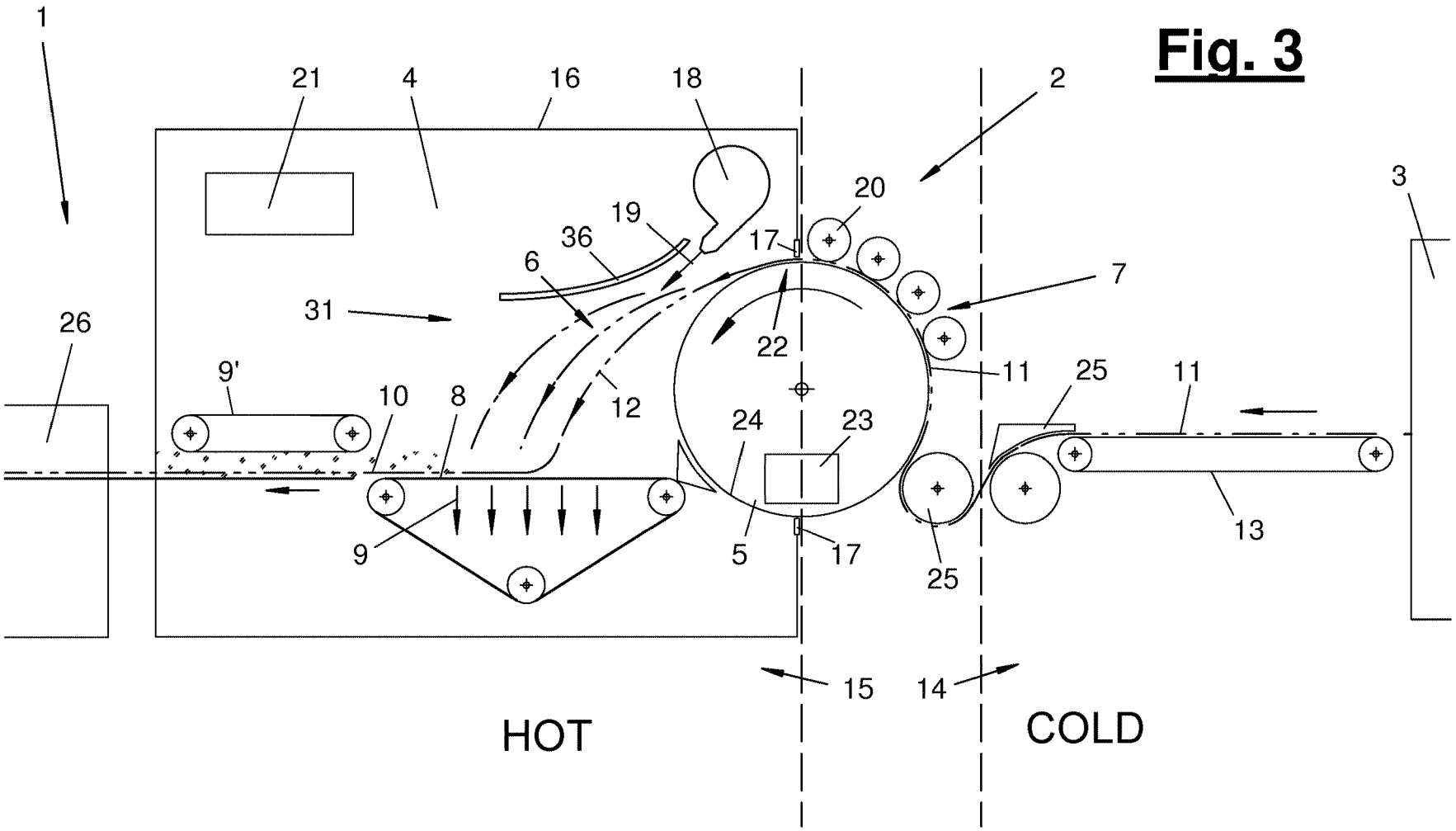
FIG. 3 is a view of a variant of FIG. 1 with a guiding device for the air stream.

FIG. 3 shows another variant of the nonwoven-forming device (2), which is largely identical to the first variant according to FIG. 1, and identical reference numbers designate identical parts.

The aforementioned cover (9') above the nonwoven pick-up unit (8) and above the fibrous nonwoven (10) laid there is shown in this third variant. The cover (9') can set or calibrate the thickness of the fibrous nonwoven (10) and compact same in the process. The fibrous nonwoven (10) can be stabilized in this thickness and with this inner fiber structure by the thermal effect in the oven (4) and due to the bonding of the interlinked fibers, which is brought about here.

FIG. 3 further shows a guiding device (36) for the emitted gas stream (19) for guiding the already emitted fiber stream (12). The guiding device (36) is configured in this variant as an air guide blade with a suitable, e.g., curved shape. The guiding device (36) is associated with the blower (18) and with the gas stream (19) being discharged in a suitable manner. The arrangement may be rigid or adjustable. The guiding device (36) extends along the gas stream (19) and guides same in the throwing-off area (6). The guiding device (36) is arranged opposite the fiber carrier (5) and on the other side of the gas stream (19).

The gas stream (19) can guide the fiber stream (12) in the manner mentioned in the introduction. It can also ensure the spreading out or fanning out of the fiber stream (12) in the conveying direction of the nonwoven pick-up unit (8). FIG. 3 shows this fanning out. The guiding device (36) can support this function of the gas stream (19) in a suitable manner due to its shape and arrangement. It has, for example, the bent shape shown for this purpose, which adjoins the blower (18) and has a convex curvature directed towards the throwing-off area (6).

Figure 4:
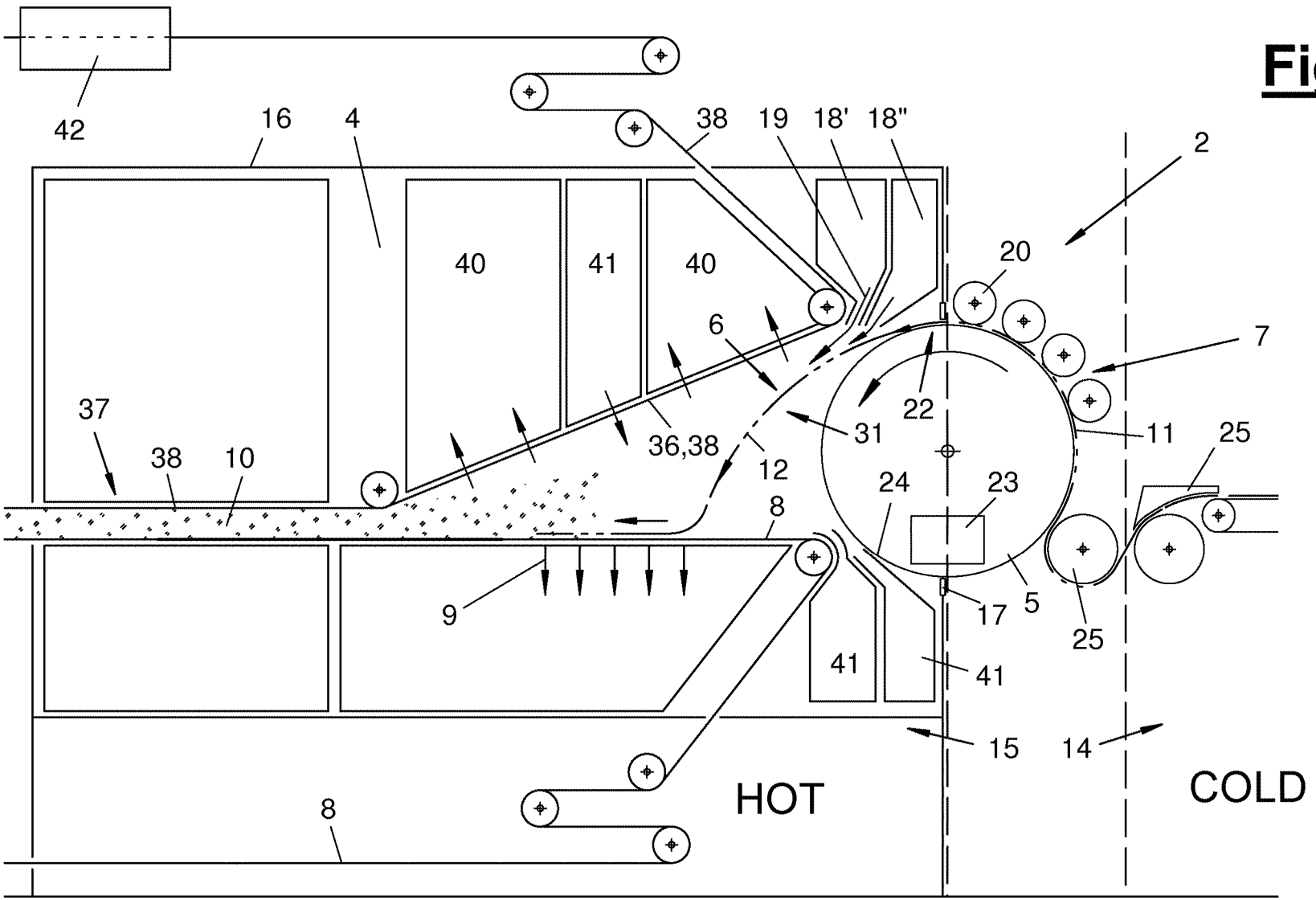
FIG. 4 is a view of another variant of the aerodynamic nonwoven-forming device with a calibrating and guiding unit.

FIG. 4 shows a fourth variant of the nonwoven-forming device (2), which is likewise largely identical to the first variant according to FIG. 1, and identical reference numbers designate identical parts.

In the fourth variant, the nonwoven-forming device (2) has in the oven (4) a calibrating and guiding unit (37) as well as a ventilating device (39). Further, a blower variant with blowers (18', 18") is shown.

The calibrating and guiding unit (37) may be used, furthermore, to set or calibrate the thickness of the nonwoven and/or to compact the fibrous nonwoven (10) on the nonwoven pick-up unit (8). The calibrating and guiding unit (37) has a circulating, flexurally elastic belt (38), which is led over deflecting rollers. The belt (38) may extend within and possibly outside the oven (4). It can enter and leave the oven housing (16) through suitable sealed openings.

Outside the oven (4), the belt (38) may be led through a schematically shown treatment device 42). The belt (38) can be treated here in a suitable manner. In particular, it may be cleaned and possibly also cooled. This makes possible a rapid changeover of the calibrating and guiding unit (37) in case of a change in the fiber material and it avoids contamination of the belt (38) with old and different fiber remnants. The nonwoven pick-up unit (8), especially the nonwoven conveyor, can also be led out of the oven (4) in a corresponding manner and guided over a corresponding treatment device (not shown).

The belt (38) may have multiple functions within the oven (4). On the one hand, it may act as a guiding device (36) and guide the gas stream (19) on the side of the removal area (6) facing away from the fiber carrier (5). The belt (36) extends for this purpose obliquely downwards starting from a point close to the blower to an area close to the nonwoven pick-up unit (8). This area of the belt may have a straight or stretched shape. As an alternative, it may also have a bent shape over a plurality of deflecting rollers.

Another function of the belt (38) pertains to the aforementioned setting or calibration of the thickness of the nonwoven and/or to compacting of the fibrous nonwoven (10) on the nonwoven pick-up unit (8). The belt (38) approaches the nonwoven pick-up unit (8) following the area in which the fiber stream (12) reaches the nonwoven pick-up unit (8). Following the aforementioned oblique position, the belt (38) is then led parallel to the nonwoven pick-up unit (8) over its further extension. This belt position may be adjustable. The fibrous nonwoven (10) is held now between the belt (38) and the nonwoven pick-up unit (8). A bilateral heating may also take place in the oven (4) in this area. The belt (38) then leaves the oven housing (16) and is returned via the treatment device 42) in the aforementioned manner.

The belt (38) is preferably permeable to air. As a result, it can also interact with the ventilation device (39).

The ventilating device (39) has a plurality of sections (40, 41) in the oven (4). These may be one or more sections (40) with suction function and one or more sections (41) with blow-in function for the process gas. The process gas contained in the oven (4), especially air, can be guided in closed circuit internally or possibly also externally by means of the mutual coordination of the sections (40, 41).

At the above-mentioned, obliquely downwards directed area of the belt (38) at the throwing-off area (6), the belt (38) may interact with one or more sections (40, 41). These sections (40, 41) are arranged, e.g., above the belt (38) and point with their inflow opening or outflow opening towards the air-permeable belt (38). The sections (40, 41) are beveled at said opening areas corresponding to the slope of the belt. The sections (40, 41) may be formed by guide plates, sealed-off ducts or in another manner.

One or more additional sections, especially blowing sections (41), may be arranged in the lower area of the oven between the fiber carrier (5) and the nonwoven pick-up unit (8). For example, process gas, especially air, set at different temperatures, may be blown in here. For example, hot gas, especially hot air, may be blown in at the blowing section (41) located adjacent to the nonwoven pick-up unit (8) and deflected around the belt deflection of the nonwoven pick-up unit (8) with a bent blow-in nozzle. Cooler gas, especially ambient air, may be blown in at the other blowing section (41) located adjacent to the fiber carrier (5). The gas feed at this lower point at the throwing-off area (6) may be used to swirl the fiber stream (12) and also to fan it out or to spread it out. Swirling is favorable for bringing about different fiber orientations in the laid fibrous nonwoven (10), and especially an irregular matted nonwoven.

A hot gas, especially hot air, may be blown in through the belt (38) at the upper blowing section (41) above the belt (38). This blown stream may likewise be used to guide the fiber stream (12). In addition, it pushes the fibers in the entry area against the nonwoven pick-up unit (8). Said section (41) is arranged, for example, between two suction sections (40).

Said gas stream (19) preferably directed tangentially and from the top onto the fiber stream (12) emitted in free flight may be generated in a different manner in the variant according to FIG. 4. For example, a blower (18'), which adjoins the upper end of the oblique area of the belt at the deflection point or at the deflecting roller of the belt (38), is present for this purpose. The blower (18) emits a hot gas stream (19), especially a hot air stream.

An additional blower (18"), which emits a gas stream (19) having a different controlled temperature, is arranged between the blower (18') and the adjacent upright housing wall. This blower is arranged with its outlet opening or outlet nozzle closer to the fiber carrier (5) than is the first blower (18'). The temperature-controlled gas stream, especially air stream, may be cold or slightly heated. The emitted gas stream (19) is likewise directed essentially tangentially to the thrown-off fiber stream (12).

Additional sections may be arranged in the other housing areas of the oven (4). This housing area may, as an alternative, be free. Said sections (40, 41) may be connected to one another or be separated from one another. They may be connected to an external or internal circulating device (not shown).

FIG. 4 shows, in addition, another embodiment of the nonwoven pick-up unit (8). It is configured as a belt type conveyor here, wherein the belt is deflected downward at the deflection point close to the fiber carrier (5) and is led out of the bottom of the hot oven area. From here, it can leave the oven housing (16) to the outside and be deflected outside the oven (4) towards the likewise exiting upper belt run. The aforementioned treatment device (42) (not shown) may be arranged in this area.

Said belts of the different conveyors have a flexurally elastic configuration and are led in a suitable manner over deflecting rollers and are driven in a circulating manner, e.g., by an electric motor drive.

Different variants of the exemplary embodiments shown and described and of the variants mentioned are possible. In particular, the features of the exemplary embodiments and of the variants may be combined with one another and possibly also replaced with one another.

While specific embodiments of the invention have been shown and described in detail to illustrate the application of the principles of the invention, it will be understood that the invention may be embodied otherwise without departing from such principles.

The invention claimed is:

1. An aerodynamic nonwoven-forming device for a fibrous nonwoven, the aerodynamic nonwoven-forming device comprising:

a nonwoven-forming device having a throwing-off area for fibers, in which the fibrous nonwoven is formed aerodynamically, the nonwoven-forming device being integrated in the throwing-off area into an oven, wherein the nonwoven-forming device has a fiber carrier, the fiber carrier being configured as one of a rotating cylindrical tambour and as a bent conveyor belt circulating at a high speed, the fiber carrier emitting a fiber stream in the throwing-off area into a free space within the oven, wherein the fiber carrier throws off the fiber stream at a separation area into the free space of the oven in free flight, the separation area being arranged at an upper apex of the fiber carrier, wherein the throwing-off area and at least the separation area of the fiber carrier being enclosed by a housing of the oven with an inner heating atmosphere, wherein the fiber carrier protrudes in some areas into the housing of the oven, and another part of the fiber carrier is located outside the housing in a cooler ambient atmosphere.

2. An aerodynamic nonwoven-forming device in accordance with claim 1, wherein a nonwoven pick-up unit is arranged in the throwing-off area, wherein the nonwoven pick-up unit is enclosed by the housing of the oven with the inner heating atmosphere.

3. An aerodynamic nonwoven-forming device in accordance with claim 1, wherein the oven has a heating device and a circulating device for the oven air.

4. An aerodynamic nonwoven-forming device in accordance with claim 3, wherein the circulating device emits a hot air stream directed along the fiber stream, wherein the hot air stream reaches the fiber stream from the top and in a flight direction at a spaced location downstream of the separation area.

5. An aerodynamic nonwoven-forming device in accordance with claim 4, wherein the nonwoven-forming device has a guiding device for the hot air stream.

6. An aerodynamic nonwoven-forming device in accordance with claim 1, wherein the nonwoven-forming device has a calibrating and guiding unit with a circulating belt extending obliquely downwards.

7. An aerodynamic nonwoven-forming device in accordance with claim 6, wherein the nonwoven-forming device has a ventilating device with one or more suction and blowing sections in the oven, wherein the belt is led along inflow or outflow sides of a plurality of sections.

8. An aerodynamic nonwoven-forming device in accordance with claim 1, wherein at least half of the fiber carrier protrudes into a housing of the oven, and another part of the fiber carrier is located outside the housing in a cooler ambient atmosphere.

9. An aerodynamic nonwoven-forming device in accordance with claim 8, wherein the housing of the oven is sealed against the fiber carrier.

10. An aerodynamic nonwoven-forming device in accordance with claim 2, wherein a holding device is arranged at the nonwoven pick-up unit, wherein the holding device has a suction device and a cover with an endless circulating conveyor belt above the nonwoven pick-up unit and the fibrous nonwoven laid at the nonwoven pick-up unit, wherein the cover adjoins an entry area of the fiber stream in a conveying direction.

11. An aerodynamic nonwoven-forming device in accordance with claim 1, wherein the nonwoven-forming device has a charging device for electric or electrostatic charging of the fibers.

12. A nonwoven-forming device in accordance with claim 6, wherein the belt is air-permeable.

13. A nonwoven-forming device in accordance with claim 1, wherein the nonwoven pick-up unit is configured as a nonwoven conveyor.

14. A nonwoven-forming device in accordance with claim 4, wherein the oblique hot air stream is directed tangentially to the emitted fiber stream.

15. A fiber plant comprising:

an aerodynamic nonwoven-forming device for a fibrous nonwoven, the nonwoven-forming device comprising a throwing-off area for fibers, in which the fibrous nonwoven is formed aerodynamically, the nonwoven-forming device being integrated in the throwing-off area into an oven, wherein the nonwoven-forming device has a fiber carrier, the fiber carrier being configured as one of a rotating cylindrical tambour and as a bent conveyor belt circulating at a high speed, the fiber carrier emitting a fiber stream in the throwing-off area into a free space within the oven, wherein the fiber carrier throws off the fiber stream at a separation area into the free space of the oven in free flight, the separation area being arranged at an upper apex of the fiber carrier, wherein the throwing-off area and at least the separation area of the fiber carrier being enclosed by a housing of the oven with an inner heating atmosphere, wherein the fiber carrier protrudes in some areas into the housing of the oven, and another part of the fiber carrier is located outside the housing in a cooler ambient atmosphere.

16. A fiber plant in accordance with claim 15, further comprising:

a fiber processing device arranged upstream of the nonwoven-forming device; and a strengthening device arranged downstream of the nonwoven-forming device.

17. A process for an aerodynamic formation of a fibrous nonwoven in a throwing-off area for fibers of a nonwoven-forming device, the process comprising:

integrating a nonwoven formation in the throwing-off area into an oven, wherein a fiber carrier of the nonwoven-forming device emits a fiber stream in the throwing-off area into a free space within the oven, the fiber carrier being configured as one of a rotating cylindrical tambour and as a bent conveyor belt circulating at a high speed, wherein the fiber stream is thrown off at a separation area of the fiber carrier into the free space in free flight, the separation area being arranged at an upper apex of the fiber carrier, wherein the throwing-off area and at least the separation area of the fiber carrier being enclosed by a housing of the oven with an inner heating atmosphere, wherein the fiber carrier protrudes in some areas into the housing of the oven, and another part of the fiber carrier is located outside the housing in a cooler ambient atmosphere.

18. A process in accordance with claim 17, wherein the fiber stream is decelerated in the free space and the fiber stream forms a floating fiber cloud, wherein the floating fiber cloud is formed at a spaced location from a nonwoven pick-up unit.

19. A process in accordance with claim 17, wherein the emitted fiber stream moves in the throwing-off area in free flight and along a downwards directed ballistic curve, wherein the emitted fiber stream is guided by a gas stream.

20. A process in accordance with claim 17, wherein the emitted fiber stream is spread out by a hot air stream.

* * * * *